US005464152A

United States Patent [19]

Wabnitz

[11] Patent Number: 5,464,152

[45] Date of Patent: Nov. 7, 1995

[54] METHOD AND APPARATUS FOR ELECTRICALLY ISOLATING A RAIL IN A PRECAST CONCRETE GRADE CROSSING

[75] Inventor: Benjamin Wabnitz, Gig Harbor, Wash.

[73] Assignee: Pacific International Pipe Enterprises, Inc., Portland, Oreg.

[21] Appl. No.: 179,144

[22] Filed: Jan. 7, 1994

[51] Int. Cl.[6] ..... E01B 1/00

[52] U.S. Cl. ..... 238/8; 238/7

[58] Field of Search ..... 238/7, 8, 152, 238/265, 283, 382

[56] References Cited

U.S. PATENT DOCUMENTS

| | | | |
|---|---|---|---|
| 846,901 | 11/1906 | Bossert . | |
| 1,467,842 | 10/1921 | Daley et al. . | |
| 1,725,410 | 8/1929 | Muchnic . | |
| 2,835,451 | 5/1958 | Goulding, Jr. | 238/8 |
| 3,317,137 | 5/1967 | Harmon . | |
| 4,210,281 | 7/1980 | Fee . | |
| 4,232,822 | 11/1980 | Hahn et al. . | |
| 4,449,666 | 5/1984 | Hales et al. . | |
| 4,606,498 | 8/1986 | Grant et al. | 238/8 |
| 4,641,779 | 2/1987 | O'Brien et al. . | |
| 4,793,545 | 12/1988 | Raymond | 238/8 |

FOREIGN PATENT DOCUMENTS

| | | | |
|---|---|---|---|
| 4221106 | 8/1992 | Japan | 238/8 |
| 5202501 | 8/1993 | Japan | 238/382 |

*Primary Examiner*—Robert J. Oberleitner
*Assistant Examiner*—S. Joseph Morano
*Attorney, Agent, or Firm*—Marger, Johnson, McCollom & Stolowitz

[57] ABSTRACT

A precast concrete grade crossing includes a plurality of base members, each of which has a central recess formed in the upper surface thereof. A pair of rails are each encased by a rubber boot which extends through the crossing in a single continuous piece. The boot-encased members are received in the recess which includes a shoulder along the outer side of each rail. The shoulder bears against a lip of the boot which extends upwardly to along outer side of the head of the rail to prevent moisture from entering the space between the boot and the rail below the shoulder.

14 Claims, 2 Drawing Sheets

METHOD AND APPARATUS FOR ELECTRICALLY ISOLATING A RAIL IN A PRECAST CONCRETE GRADE CROSSING

BACKGROUND OF THE INVENTION

1. Field of the Invention

The present invention relates generally to methods and apparatus for electrically isolating a rail on a concrete grade crossing and more particularly to such a method and apparatus utilized in connection with a grade crossing formed of precast concrete as opposed to concrete cast in place.

2. Description of the Related Art

Special preparation of a rail bed is necessary whenever a road or pedestrian walkway crosses a rail bed at grade level. Generally such crossings are constructed such that the surface of the road is at approximately the same level as the upper surface of the rails. The recessed area between the rails and to either side thereof are built up to street level with the exception that recesses must be provided adjacent the upper portion of each rail to accommodate the flanges on railcar wheels.

This crossing construction has been accomplished in the past by filling the recessed area with materials such as wood or asphaltic paving materials. Cast-in-place and precast concrete crossing structures have also been used.

Elastomeric boots have been utilized in the past in connection with precast concrete grade crossings as well as with cast-in-place concrete grade crossings which are formed at the site of the crossing by pouring concrete into a form containing the boot-encased rail. Boots may be made of a rubbery compound such as synthetic butyl rubber or EPDM and may be a 3/16 to ½ inch in thickness. The material used in the past has a Durometer of 80–85. Other such prior art boots have a thickness of 0.165 or 0.200 inch with a Durometer of 70 ±5.

One prior art boot used in connection with a precast concrete grade crossing system is disclosed in U.S. Pat. No. 4,641,779 to O'Brien, et al. In this system, the boot entirely encases the flange or lower portion of each rail. The boot extends from the flange along each side of the rail and terminates, on both sides of the rail, at a point just beneath the head or upper portion of the rail upon which a train wheel is supported. While the boot disclosed in the O'Brien, et al. patent works well to cushion the rail against abrasion and vibration, because the entire head of the rail is exposed, there may be electrical conductivity between the rail and the precast concrete in which it is secured. This condition is aggravated in regions where salt is applied to roads in snowy and icy weather by increasing the conductivity of water accumulating on the crossing. When the rail is not electrically isolated, it cannot be effectively used as a signal conductor. In addition, current flowing between the rail and the concrete accelerates corrosion.

In the O'Brien, et al. system, isolation of the gauge or inner side of each rail has been achieved by installing an elastomeric flange in the flangeway adjacent the gauge side of each rail. Such a flange is depicted immediately to the right of the sectional view in FIG. 2 herein. Even with the flange, however, isolation of this prior art system was not totally effective for two reasons. First, the boot on the field or outer side of the rail terminated beneath the head of the rail thereby exposing the outer portion of the head to the elements. Secondly, the boots in this prior art system were not installed in continuous lengths throughout the crossing. They were, rather, installed in sections with seams between each section presenting the potential for leakage currents flowing between the rail and the concrete.

One prior art boot has been proposed for use in connection with a grade crossing of the type which is cast in place. The lower portion of this prior art boot encases the base and web of the rail as is the case with the O'Brien, et at. patent. The gauge side of the prior art boot extends upwardly to cover substantially all of the underside of the head. The field side of the prior art boot extends vertically up the field side of the head. Thereafter, the rail is positioned in the crossing and concrete is placed so as to surround that portion of the rail encased by the boot.

It would be desirable to provide an elastomeric boot for a rail in a precast concrete grade crossing which covers the field side of the head and which is held in place so as not to permit water and other materials from leaking into the space between the boot and the rail.

It would also be desirable to eliminate seams between adjacent lengths of elastomeric boot in precast concrete grade crossings.

SUMMARY OF THE INVENTION

The present invention comprises a method for electrically isolating a rail in a precast concrete grade crossing that has a base member formed with a central recess. The central recess includes parallel walls formed to conform generally to the outer surface of the rail which has a base portion, a web portion and a head portion.

The rail is encased in an elastomeric boot which extends from the base portion to cover substantially all of the outer surfaces of the head portion. The boot-encased rail is positioned in the central recess of the base member with the outer surface of the rail being directed toward one of the walls of the central recess. A generally planar panel is positioned adjacent the inner surface of the rail. The boot-encased rail is forced against one wall of the central recess until the wall is in sealing engagement with a portion of the boot covering the outer surface of the head portion. The planar panel is fastened to the base member such that the boot-encased rail is maintained in such sealing engagement. In another aspect of the invention, the boot for each rail is a single continuous boot from one end of the crossing to the other.

Apparatus for implementing the method of the present invention is also provided.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 3:
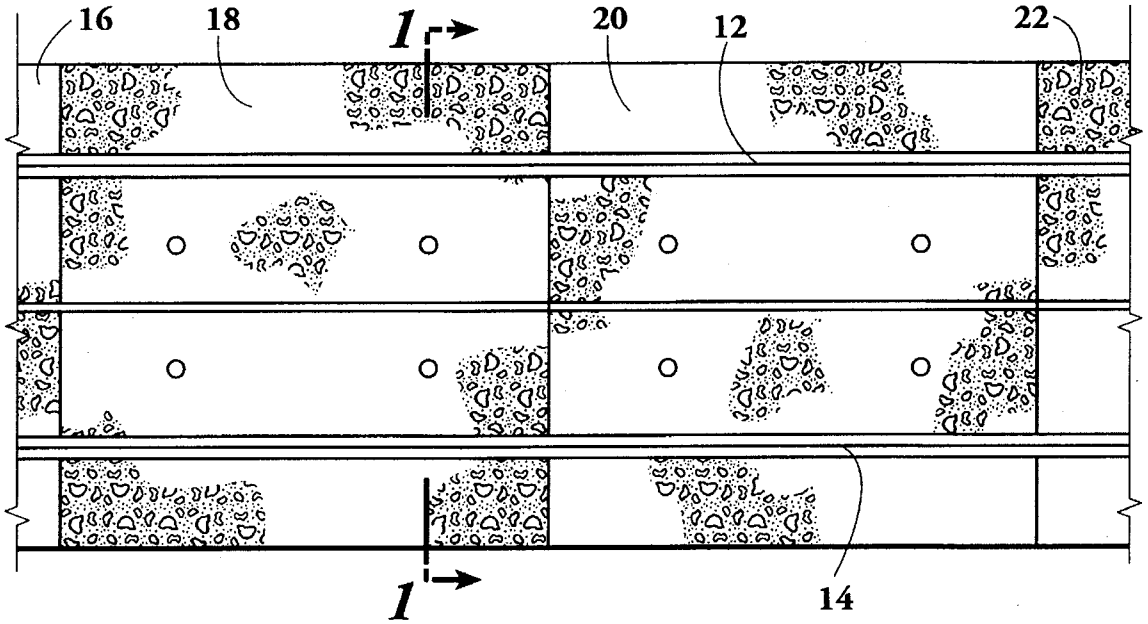
FIG. 3 is a plan view of a precast concrete grade crossing constructed in accordance with the present invention in which a plurality of base members and panels are positioned end-to-end with FIG. 1 being a sectional view along line 1—1 in FIG. 3.
Figure 1:
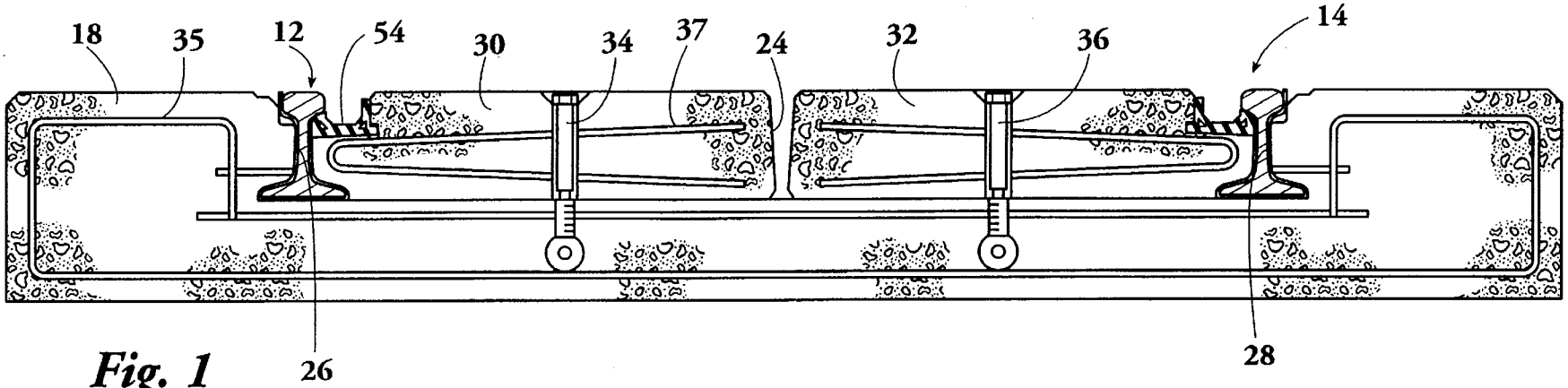
FIG. 1 is an elevational sectional view of a precast concrete grade crossing constructed in accordance with the present invention.

Referring now to the drawings, indicated generally at 10 in FIG. 3 is a grade crossing for a pair of rails 12, 14 which form a railroad track. Crossing 10 is made up of a plurality of precast concrete base members, four of which are base members 16, 18, 20, 22, laid end-to-end. Each base member includes a central recess having a floor, like floor 24 in base member 18, and a pair of opposed parallel walls, like walls 26, 28, also in base member 18. First and second precast concrete panels 30, 32 are supported by floor 24 within the central recess and are bolted via bolt 34, 36, respectively, to base member 18. In FIG. 1, reinforcing steel rods, two of which are rods 35,37, can be seen in both base member 18 and in panels 30, 32.

A prior art concrete grade crossing system is disclosed in U.S. Pat. No. 4,641,779 to O'Brien, et al. which is incorporated herein by reference.

Figure 2:
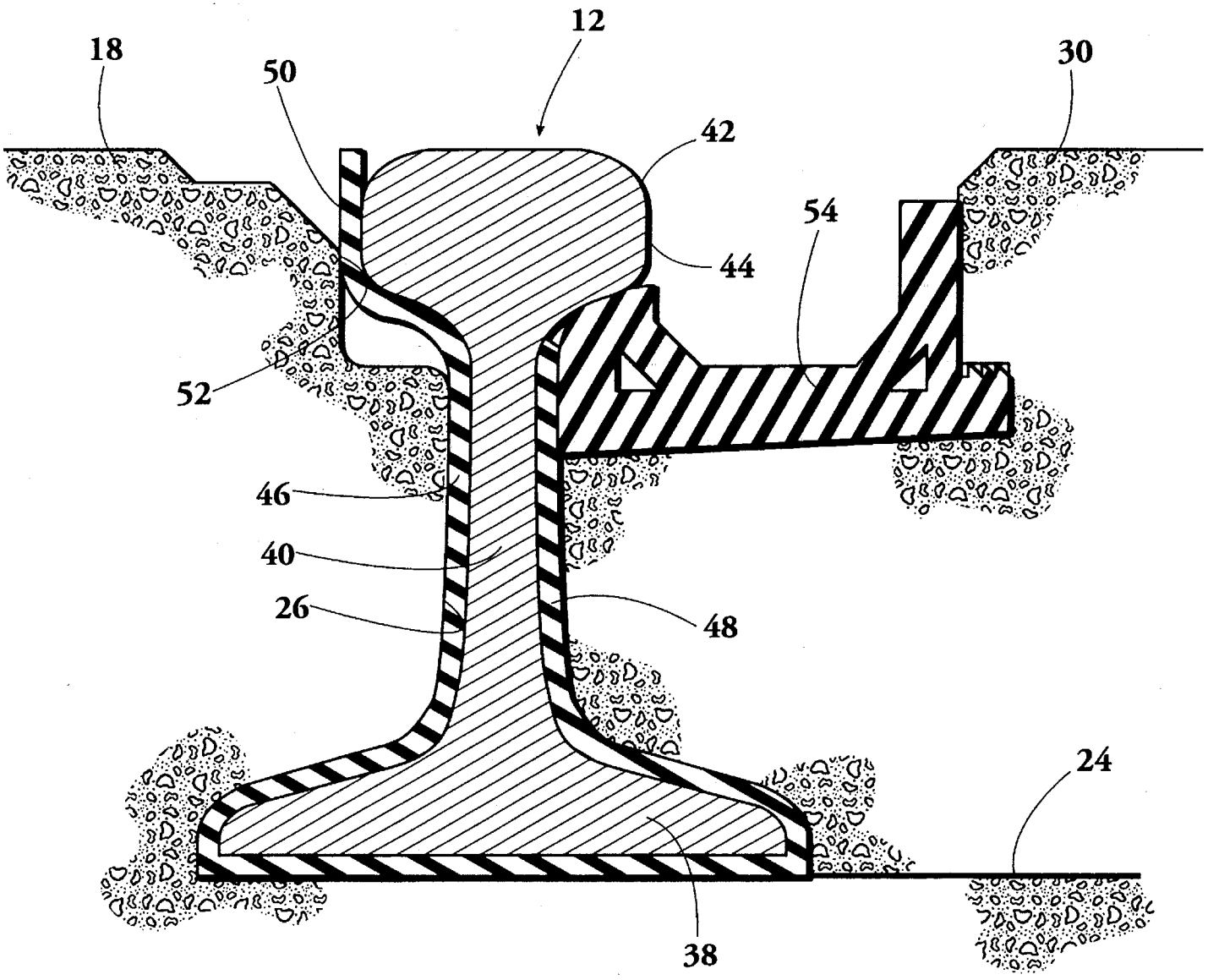
FIG. 2 is an enlarged view of a portion of FIG. 1.

With reference now to FIG. 2, rail 12 includes a base portion 38, a web portion 40, and a head portion 42. Rail 12 includes an inner surface 44 which comprises that side of the rail as viewed in FIG. 2 which is directed toward panel 30. The rail also includes an outer surface 46 comprising that side of the rail directed toward base-member wall 26.

An elastomeric boot 48 encases rail 12 as shown in FIG. 2. The boot can be made of an EPDM or a thermoplastic material which has an appropriate resilience for limiting vibration and which is sufficiently tough to prevent abrasion of the concrete by the rail. In addition, boot 48 must have a sufficient resistivity, both when dry and when exposed to water which may have salt, to electrically isolate the rail. A person having ordinary skill in the art to which the present invention relates can specify a suitable material to form boot 48.

As can be seen in FIG. 2, boot 48 includes a lip 50 which extends upwardly along the outer side of rail 44 to substantially cover the outer side of the head. A shoulder 52 formed on base member 18 forces lip 52 into sealing engagement with the outer surface of head 44. This prevents water from entering the space between the boot and the rail below shoulder 52 and thereby electrically insulates the rail from the precast concrete holding it.

An elastomeric flange 54 is received in a channel formed in panel 30 as shown. Flange 54 seals against the underside of head 44 as shown thus preventing water from entering the space between boot 48 and the rail on the inner side thereof.

It should be noted that although the entire crossing is not shown, elastomeric boot 48 extends in a single continuous piece across each base member, like base member 16, 18, 20, and 22, in the crossing thereby maintaining electrical isolation from all of the precast concrete components which form the crossing.

As can be seen in FIG. 1, rail 14 is surrounded by an elastomeric boot substantially identical to boot 48. A flange, like flange 54 in FIG. 2, performs a similar function with respect to rail 14 and its associated boot. An enlarged section of rail 14 similar to that shown in FIG. 2 would comprise substantially a left-to-right mirror image of the view of FIG. 2.

The concrete grade crossing of the present invention is installed substantially as described in the O'Brien et at. patent.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

I claim:

1. A method for electrically isolating a rail in a precast concrete grade crossing having a base member formed with a central recess, said central recess having parallel walls formed to conform generally to the outer surface of a rail, said method comprising the steps of:

providing a boot formed from substantially planar elastomeric material molded to conform to a substantial portion of the surface of said rail:

encasing a rail having a base portion, a web portion and a head portion in said elastomeric boot which extends from said base portion to cover substantially all of the outer surface of said head portion when said rail is so encased;

positioning the boot-encased rail in the central recess of the precast base member with the outer surface of the rail being directed toward one of the walls of the central recess;

pinching a substantially planar portion of the boot between a substantially vertical surface formed on said one wall of the central recess and an outer substantially vertical surface of the head portion until the boot is in sealing engagement with said head portion; and maintaining the boot-encased rail in such sealing engagement.

2. The method of claim 1 wherein the step of maintaining the boot-encased rail in such sealing engagement comprises the steps of:

positioning a generally planar panel adjacent the inner surface of the rail; and fastening the planar panel to the base member such that the boot-encased rail is wedged into such sealing engagement.

3. The method of claim 1 wherein said method further includes the step of positioning a plurality of base members end to end.

4. The method of claim 3 wherein the step of encasing a rail having a base portion, a web portion and a head portion in said elastomeric boot comprises the step of encasing the rail in a single boot which extends through all of the base members in the crossing.

5. The method of claim 1 wherein said method further comprises the steps of:

providing a second boot formed from substantially planar elastomeric material molded to conform to a substantial portion of the surface of said rail:

encasing a second rail having a base portion, a web portion and a head portion in said second elastomeric boot which extends from said base portion to cover substantially all of the outer surface of said head portion when said second rail is so encased;

positioning the second boot-encased second rail in the central recess of the precast base member with the outer surface of the second rail being directed toward the other of the walls of the central recess;

pinching a substantially planar portion of the boot between a substantially vertical surface formed on said other wall of the central recess and an outer substantially vertical surface of the head portion until the boot is in sealing engagement with said head portion; and maintaining the second boot-encased rail in such sealing engagement.

6. The method of claim 5 wherein said method further comprises the step of positioning a plurality of base members end to end and wherein the step of encasing a second rail having a base portion, a web portion and a head portion in said second elastomeric boot comprises the step of encasing the second rail in a single boot which extends through all of the base members in the crossing.

7. The method of claim 5 wherein the step of maintaining the second boot encased rail in such sealing engagement comprises the steps of:

positioning a generally planar second panel adjacent the inner surface of the second rail;

fastening the planar second panel to the base member such that the boot-encased second rail is wedged into such sealing engagement.

8. Apparatus for electrically isolating a rail in a precast concrete grade crossing, said apparatus comprising:

a precast concrete base member formed with a central recess, said central recess having parallel walls formed to conform generally to the outer surface of a rail;

a rail having a base portion, a web portion and a head portion;

an elastomeric boot encasing said rail and extending from said base portion to cover substantially all of the outer surface of said head portion, said boot being formed from substantially planar elastomeric material molded to conform to a substantial portion of the surface of said rail; and a substantially vertical surface formed on one of said parallel walls, said vertical surface being opposite a substantially vertical surface formed on the outer surface of the head when the rail is forced against said one wall of the central recess; and a space defined between said vertical wall surface and said vertical head surface and being sized to pinch said boot between said vertical wall surface and said vertical head surface when the boot-encased rail is forced against said one wall of the central recess.

9. The apparatus of claim 8 wherein said apparatus further includes a plurality of base members positioned end to end.

10. The apparatus of claim 9 wherein said elastomeric boot comprises a single boot which extends through all the base members in the crossing.

11. The apparatus of claim 10 wherein said apparatus further includes:

a generally planar second panel positioned adjacent the inner surface of the second rail; and means for fastening the planar second panel to the base member such that the boot is maintained in such sealing engagement.

12. The apparatus of claim 8 wherein said apparatus further includes: a generally planar panel positioned adjacent the inner surface of the rail; and means for fastening the planar panel to the base member such that the boot is maintained in such sealing engagement.

13. The apparatus of claim 12 wherein said apparatus further includes a plurality of base members positioned end to end and wherein said second elastomeric boot comprises a single boot which extends through all the base members in the crossing.

14. The apparatus of claim 8 wherein said apparatus further includes:

a second rail having a base portion, a web portion and a head portion;

a second elastomeric boot encasing said second rail and extending from said base portion to cover substantially all of the outer surface of said head portion, said second boot being formed from substantially planar elastomeric material molded to conform to a substantial portion of the surface of said rail; and a substantially vertical surface formed on the other of said parallel walls said vertical surface being opposite a substantially vertical surface formed on the outer surface of the head when the second rail is forced against said one wall of the central recess; and a space defined between said vertical wall surface and said vertical head surface and being sized to pinch said second boot between said vertical wall surface and said vertical head surface when the boot-encased rail is forced against said one wall of the central recess.

* * * * *